US005337895A

United States Patent [19]

Mitelman et al.

[11] Patent Number: 5,337,895

[45] Date of Patent: Aug. 16, 1994

[54] PROTECTIVE END CAP FOR PAPER ROLLED ON A TUBE

[75] Inventors: Roman Mitelman, Memphis, Tenn.; Gary B. Smith, Olive Branch, Miss.

[73] Assignee: Cleo, Inc., Memphis, Tenn.

[21] Appl. No.: 985,614

[22] Filed: Dec. 3, 1992

[51] Int. Cl.[5] ..... B65D 85/671

[52] U.S. Cl. ..... 206/416; 206/415; 229/5.5; 229/93; 53/397; 493/162

[58] Field of Search ..... 206/226, 395, 402, 407, 206/443–416; 229/4.5, 5.5, 93, 125.17, 169, 170; 493/162, 183; 53/397

[56] References Cited

U.S. PATENT DOCUMENTS

| | | | |
|---|---|---|---|
| D/ 137,487 | 7/1943 | Van Cleef . | |
| D. 205,276 | 7/1966 | Kort . | |
| 224,668 | 2/1880 | Felt . | |
| 405,311 | 6/1889 | Herberling . | |
| 407,583 | 7/1899 | Ehret, Jr. . | |
| 539,348 | 5/1895 | Caldwell . | |
| 713,938 | 11/1902 | Bache . | |
| 916,325 | 3/1909 | Kelly . | |
| 932,808 | 8/1909 | Pelton . | |
| 996,510 | 6/1911 | Oltsch . | |
| 996,511 | 6/1911 | Oltsch . | |
| 1,029,947 | 6/1912 | Rothermel . | |
| 1,201,454 | 10/1916 | Godbold et al. . | |
| 1,265,403 | 1/1921 | Holway . | |
| 1,272,047 | 7/1918 | Jackson . | |
| 1,312,202 | 8/1919 | Perry . | |
| 1,482,219 | 1/1924 | Brooks . | |
| 1,548,632 | 8/1925 | Rothermel . | |
| 1,552,129 | 9/1925 | Felton . | |
| 1,861,294 | 5/1932 | Bartlett . | |
| 1,887,945 | 11/1932 | Richer . | |
| 1,897,334 | 2/1933 | Richer . | |
| 1,946,554 | 2/1934 | Sutherland . | |
| 1,965,199 | 7/1934 | McAleer . | |
| 2,034,471 | 3/1936 | Joyce . | |
| 2,044,422 | 6/1936 | Davidson . | |
| 2,049,379 | 7/1936 | Hosking . | |
| 2,307,250 | 1/1943 | Winchell . | |
| 2,328,119 | 8/1943 | Allen . | |
| 2,328,563 | 9/1943 | Lichter | 229/169 |
| 2,339,475 | 1/1944 | Hartsell et al. . | |
| 2,341,374 | 2/1944 | Gardner . | |
| 2,345,190 | 3/1944 | Freund . | |
| 2,407,118 | 9/1946 | Waters | 493/162 |
| 2,432,501 | 12/1947 | Belanger . | |
| 2,460,434 | 2/1949 | Salem . | |
| 2,491,213 | 12/1949 | Robinson, Jr. . | |
| 2,493,671 | 1/1950 | Horning | 229/125.17 |
| 2,496,043 | 1/1950 | Farrell | 229/5.5 |
| 2,537,184 | 1/1951 | Dunn . | |
| 2,665,216 | 1/1954 | Jungmayr . | |
| 2,726,803 | 12/1955 | Ketler . | |
| 2,740,572 | 4/1956 | Welshenbach . | |
| 2,828,061 | 3/1958 | Zerlin | 229/125.17 |
| 3,115,292 | 12/1963 | Repking . | |
| 3,204,849 | 9/1965 | Vinney . | |
| 3,229,811 | 1/1966 | Studwell . | |
| 3,233,728 | 2/1966 | Johnson et al. . | |
| 3,285,496 | 1/1966 | Barnhardt, Sr. et al. . | |
| 3,441,127 | 4/1969 | Manning . | |
| 3,465,944 | 9/1969 | Robinson | 229/5.5 |
| 3,770,118 | 11/1973 | Jones . | |
| 3,829,008 | 8/1974 | Murray et al. . | |
| 3,929,226 | 12/1975 | Nijs . | |

(List continued on next page.)

*Primary Examiner*—Jimmy G. Foster
*Attorney, Agent, or Firm*—Wood, Herron & Evans

[57] ABSTRACT

A single-piece protective end cap for insertion into the ends of a tube of rolled sheet material to protect and contain the exposed edges of the rolled sheet material and reinforce the ends of the tube has a central panel with hingedly attached intermediate panels foldable to extend substantially perpendicular to the central panel to collectively form a tubular section with longitudinal edges coincident with the inside surface of the tube for holding the end cap firmly in the end of the tube, and outer panels hingedly attached to the intermediate panels and foldable to extend substantially perpendicular thereto and parallel the central panel to provide a peripheral lip around the tubular section which contains and protects the exposed edges of the sheet material when the end cap tubular section is inserted into the end of the tube.

36 Claims, 2 Drawing Sheets

U.S. PATENT DOCUMENTS 4,015,711 4/1977 Mason .
4,029,202 6/1977 Lasich et al. .
4,122,949 10/1978 Blatt .
4,153,157 5/1979 de Volpi .
4,186,833 2/1980 Homan .
4,339,885 7/1982 Brown .
4,432,457 2/1984 Sawa et al. .
4,513,864 4/1985 Liebel .
4,516,892 5/1985 Curro, Jr. .
4,712,726 12/1987 Fonas .
4,726,509 2/1988 Fonas .
4,858,762 8/1989 Kewin .
4,987,019 1/1991 Jones .

PROTECTIVE END CAP FOR PAPER ROLLED ON A TUBE

FIELD OF THE INVENTION

This invention relates to end caps for tubes of rolled gift wrap paper to strengthen the ends of the tubes and protect the edges of the rolled sheet material, as well as to end cap and tube assemblies having gift wrap rolled on the tube with its edges interiorly adjacent protective lips of the end caps.

BACKGROUND OF THE INVENTION

Decorative gift wrap paper is often sold in long sheets rolled onto cardboard tubes or cylinders, which sheets are later cut into various shapes and lengths as desired by the user.

When paper is rolled onto a tube, the edges of the paper sheets are exposed at the tube ends and are thus subject to damage when the tube of material is being stored, handled, or shipped. Rolled decorative gift wrap paper is particularly susceptible to such damage because it is normally very thin, leaving very fragile edges exposed at the tube ends. Consequently, end caps are necessary at the ends of the tube to protect the edges of the rolled paper against damage.

Protective end caps for the edges of rolled sheet material generally are known. However, many of these devices utilize separate securing means to hold the devices firmly within the ends of the tube. The securing elements of these devices may become lost or misplaced, become loose and fall out, and often are difficult to fasten to the ends of the tube. Additionally, some of these devices are too heavy and, consequently, are unsuitable for a light roll of thin gift wrap paper.

Along with protecting the edges of the rolled paper, it is a desirable feature of an end cap to strengthen the end of the tube, which is normally fabricated of thin cardboard. Many available end caps for rolls of wrapping paper do not sufficiently reinforce the tube ends. An end cap molded of plastic or some other rigid synthetic material may provide sufficient edge protection and tube end reinforcement; however, the rigid three-dimensional shape of such a device makes the end caps bulky to ship in large numbers. Additionally, because of environmental concerns it is desirable to make an end cap out of a natural, biodegradable material instead of plastic or some other synthetic material to facilitate a more environmentally safe disposal when the end caps are discarded. It is further desirable to provide an end cap which can be inexpensively manufactured and easily inserted into the end of a cylinder of rolled sheet material, such as by an automated machine.

Therefore, it is an objective of the present invention to provide a single-piece end cap for tubes of rolled sheet material which may be easily inserted and removed from the ends of the tube to protect the sheet edges and provide added strength to the tube at its ends.

It is another objective of the present invention to provide an end cap which is simple to utilize and inexpensive to manufacture, and which may be inserted in the end of a tube and held snugly therein without any need for separate fastening means.

A further objective of the present invention is to provide an end cap which may be made of an environmentally safe and biodegradable material while maintaining its strengthening properties in the end of the tube and which may be shipped in a flat two-dimensional form and easily formed into a three-dimensional end cap when needed for insertion in the end of a tube.

SUMMARY OF THE INVENTION

In accordance with these and other objectives, an end cap is provided having a flat, polygon-shaped central panel with a plurality of substantially straight outer sides. A rectangular intermediate panel having inner, outer, and opposing free sides is hingedly attached along its inner side to each of the straight outer sides of the central panel. Outer panels with inner and outer sides are hingedly connected along the inner side to each of the intermediate panels along the outer side thereof. When folded and erected for insertion in the end of a tube, all of the intermediate panels of the end cap extend substantially perpendicular to the central panel towards the same face of the central panel, and the outer panels extend substantially perpendicular to the intermediate panels and radially outwardly and parallel to the central panel to form an end cap which fits snugly into the end of a tube without separate fastening means. The adjacent intermediate panels collectively form a tubular section of the end cap wherein the opposing free sides confront each other to form the longitudinal edges of the tubular section. When the end cap tubular section is placed in the end of the tube, the longitudinal edges frictionally engage the inside wall of the tube to hold the end cap snugly therein. The adjacent outer panels collectively form an integral, peripheral lip disposed perpendicular to the tube axis and extending beyond the outermost layer of sheet material to confine and protect the exposed edges of the sheet material rolled onto the tube.

The end cap may be formed from a flat, two-dimensional die-cut paper blank by folding the rectangular intermediate panels towards one face of the central panel along their inner side of the intermediate panel to lie substantially perpendicular to the central panel. The intermediate panels have opposing, free sides, and when the intermediate panels are folded as such, to collectively form a tubular section, the tubular section has a cross section in the shape of the central panel and the longitudinal edges are located at each corner of the central panel and disposed perpendicular to the plane of the central panel. The longitudinal edges of the tubular section define points along a circle on the periphery of the central panel, and when the end cap is placed in the end of the tube, the longitudinal edges frictionally contact the inner diameter surface of the tube end to retain the end cap therein.

The outer panels are then folded along their inner sides to lie perpendicular to the intermediate panels and radially outward and parallel to the central panel to overlay the edges of sheet material at the end of the tube. In this way, the end cap is held snugly in the tube end with the outer panels containing and protecting the edges of the sheet material wrapped on the tube without the need for separate fastening means to secure the end cap in place. The end cap of the present invention may be easily removed, if desired, by grasping one of the outer sections and pulling it axially outwardly from the end of the tube. Additionally, the longitudinal edges of the tubular section formed from adjacent intermediate panels in combination with the straight sides of the central panel provide reinforcement to the end of the tube in which the end cap is inserted.

In one embodiment of the present invention, the outer sides of the outer panels are arcuate in shape so that, when folded perpendicular to the intermediate panels, the outer panels collectively form a peripheral lip or ring around the tubular section of the end cap. The peripheral lip or ring is dimensioned to have an outer diameter greater than the outer diameter of the roll of sheet material on the tube, so that it completely contains and protects the exposed edges of the rolled sheet material when the end cap is inserted into the end of the tube.

In another embodiment of the present invention, the opposing unattached sides of the intermediate panels, which form the longitudinal edges, contain cooperating tabs and notches. The tabs and notches interfit when the intermediate panels are folded perpendicular to the central panel to form the tubular section, so as to hold the tubular section together and to maintain the confronting sides of the intermediate panels in a longitudinal edge.

The present invention thus offers a single-piece end cap which fits snugly within the end of a tube without the use of separate fastening means to contain and protect the edges of paper rolled on the tube and to reinforce the end of the tube. The present invention may be made of a biodegradable substance like paper, while maintaining the strength necessary to stay seated snugly within the tube and reinforce the ends of the tube. Furthermore, the end cap of the present invention is relatively inexpensive to manufacture, and can be shipped as a flat two-dimensional blank and later folded to create the three-dimensional cap of the present invention which is easily inserted and removed from the end of the tube.

BRIEF DESCRIPTION OF THE DRAWINGS

These and other objects of the invention are more fully understood with reference to the following description of a preferred embodiment taken in conjunction with the accompanying drawings in which.

DESCRIPTION OF A PREFERRED EMBODIMENT

Figure 1:
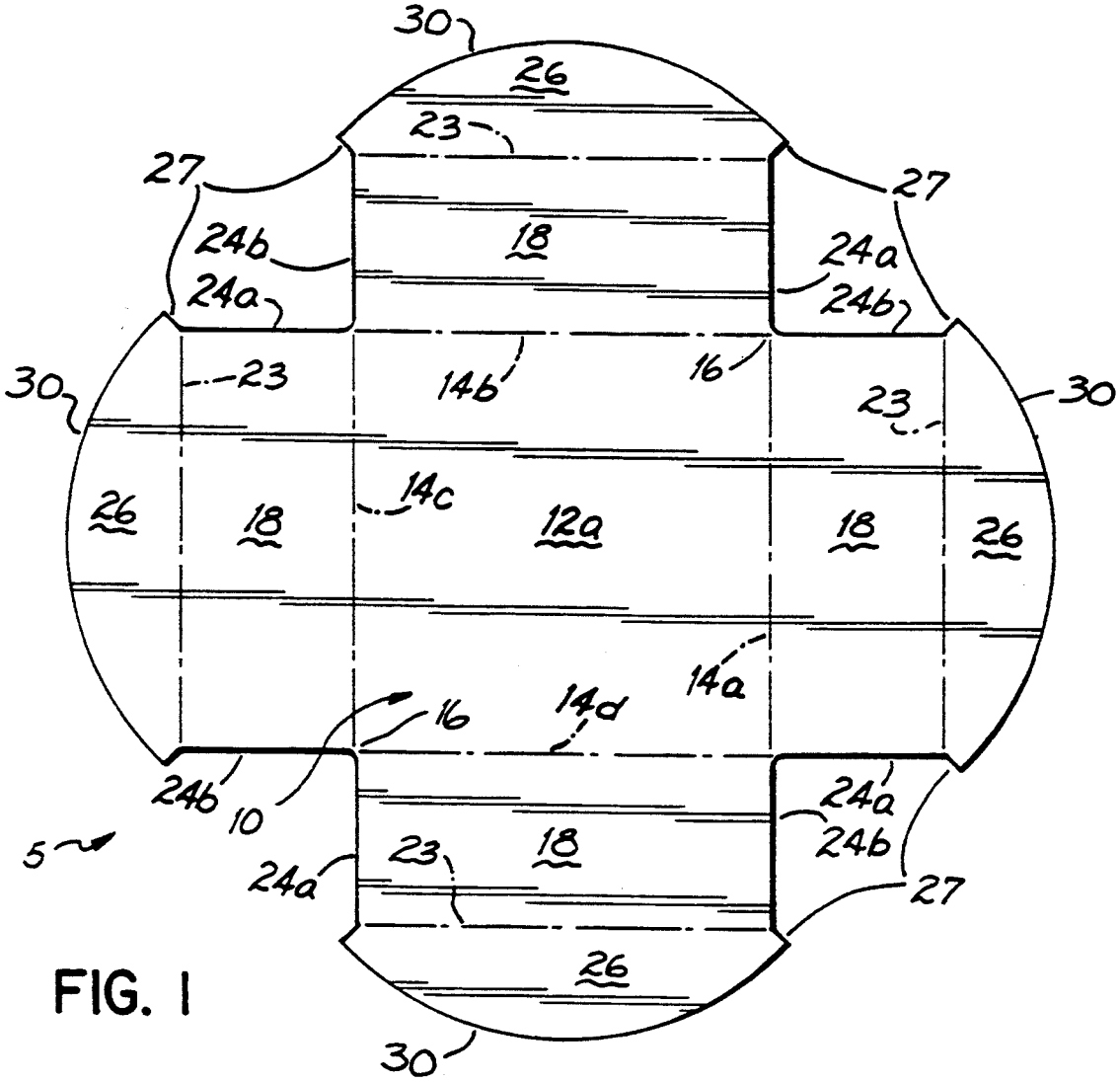
FIG. 1 is a top plan view of the die cut paper blank which is to be folded to form the end cap of the present invention.

Referring to FIG. 1, the blank 5 used to form the three-dimensional end cap of the present invention has a central panel 10 which is in the shape of a square having two opposing faces 12*a* and 12*b*, substantially straight outer sides 14*a*, 14*b*, 14*c* and 14*d* (collectively 14) and corners 16. The shape of the central panel 10 can be any polygon shape having a plurality of straight edges, although a square shape is chosen as being a preferable embodiment.

Hingedly connected to each of the outer sides 14 of central panel 10 is an intermediate panel 18. The intermediate panels 18 are preferably rectangular in shape having two, an inner side 14 and outer side 23, and two opposing free sides 24*a* and 24*b*. Hingedly connected to the outer side 23 of each intermediate panel 18 is an outer panel 26. The hinged connection, along side 14, between central panel 10 and each intermediate panel 18, permits the intermediate panel 18 to be folded toward one face surface 12*a* or 12*b* of central panel 10 so as to rest substantially perpendicular to central panel 10.

When the intermediate panels 18 are folded to rest substantially perpendicular to central panel 10, adjacent free sides 24*a* and 24*b* of adjacent intermediate panels confront each other and meet to form a longitudinal edge 42 at each corner of the central panel 10. In this way, each intermediate panel 18 meets the adjacent intermediate panels on either side, and all of the intermediate panels collectively form a tubular section 52. The tubular section 52 fits inside the end of a tube, and its plurality of longitudinal edges extend parallel to the axis of the tube 46 and abut against the inner side 48 of the tube 46 to frictionally hold the three-dimensional end cap 40 secure in the end of the tube 46 as described hereinbelow (See FIG. 2). The outer panels 26 are folded perpendicular to the intermediate panels 18 along inner side 23 and radially outward and parallel to central panel 10 to collectively form an annular lip or ring 60 around the periphery of the end cap 40 (See FIG. 2). As further described hereinbelow, the peripheral lip 60 of end cap 40 overlays and protects the delicate edges of the sheet material while rolled onto the tube, tubular section 52 and its longitudinal edges 42 frictionally hold end cap 40 securely in the end of tube 46 and support the fragile walls of the tube end.

Blank 5 used to make the end cap of the present invention may be inexpensively die cut or stamped from a biodegradable substance, such as rigid paper stock, so as to present an environmentally safe unit when the edge protector is discarded, although other material may be used if biodegradability is not a concern. Furthermore, the flat unfolded blank 5 of the present invention is thin and can be shipped in large quantities in stacks taking up only minimal shipping space.

Figure 2:
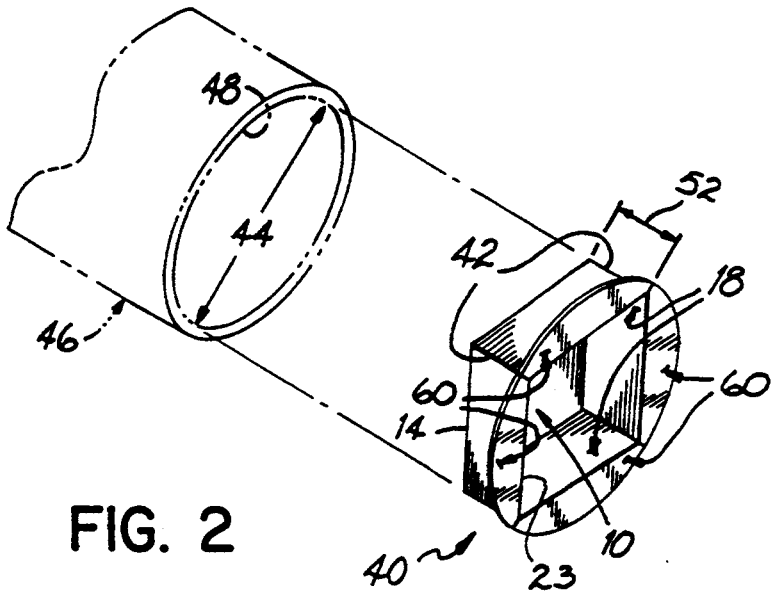
FIG. 2 is a perspective view of the erected three-dimensional end cap of the present invention.

Referring now to FIG. 2, the three-dimensional end cap 40 of the present invention is formed by folding the intermediate panels 18 at their inner side 14 towards one face surface 12*a* or 12*b* of central panel 10, so that each intermediate panel 18 rests essentially perpendicular to central panel 10 towards the same face surface of the central panel 10. In the die-cut paper blank 5 of FIG. 1 the lines of connection between the inner sides of the intermediate panels 18 and the outer sides 14 of the central panel 10 are scored or otherwise weakened so that the intermediate panels 18 can be easily folded with respect to the central panel 10. When all intermediate panels 18 are folded to rest perpendicular to the central panel 10, the adjacent free sides 24*a* and 24*b* of adjacent intermediate panels 18 confront each other to form a plurality of longitudinal edges 42, one at each of the corners 16 of central panel 10. The contact edges 42 of end cap 40 extend parallel to the axis of the tube 46 and define four chord points (or more chord points if the central panel is some other polygon shape than a square) along the circumference of a circle having a diameter which is approximately equal to the inner diameter 44 of tube 46.

As further shown by FIG. 2, when all of the intermediate panels 18 are folded towards the same face surface of central panel 10, the intermediate panels 18 collectively form the tubular section 52 of end cap 40, which fits inside the end of a tube 46 and secures the end cap 40 therein. The tubular section 52 has a cross section which is in the shape of the central panel 10. In a preferred embodiment, shown in FIG. 2, the cross section is square-shaped. However, since the corners 16 of the central panel 10 and the respective longitudinal contact edges 42 define points along the circumference of a circle, the tubular section 52 may have any polygon-shaped central panel and still fit snugly within the tube 46 due to the longitudinal edges 42 which are coincident with and abut against the inner wall 48 of the tube 46.

Figure 3:
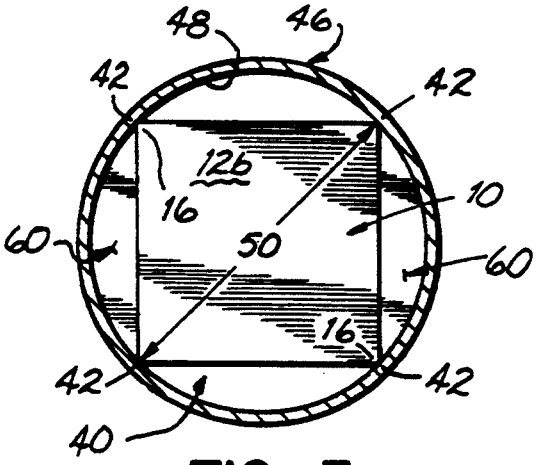
FIG. 3 is a cross-sectional view through the end of a tube showing the tubular section of the end cap of the present invention.

NOW referring to FIG. 3, when central panel 10 and the intermediate panels 18 of edge protector 40 are placed in the end of tube 46, the longitudinal edges 42 of tubular section 52 abut against the inner wall 48 of tube 46 and frictionally hold end cap 40 secure in place within the end of tube 46 without the need for independent fastening means. The absence of separate fastening means makes end cap 40 easily insertable and removable from the end of cylinder 46. Insertion of end cap 40 in the end of tube 46 can be accomplished by simply pushing the end cap 40 in at the central panel 10 until the tubular section 52 is fully inside tube 46. Similarly, removal is easily accomplished by grasping one or more of the outer panels and pulling the end cap 40 from the tube end. Referring again to FIG. 3, another way of illustrating the dimensions of the end cap 40 having a square central panel 10 and the relationship between the tubular section 52 and the inside wall 48 of the tube is that the diagonal dimension 50 of square-shaped central panel 10 is approximately the same length as the inner diameter 44 of tube 46.

In use, end cap 40 is inserted into the end of tube 46 so that central panel 10 lies essentially perpendicular the main axis of tube 46. The tubular section 52 of the end protector 40 fits essentially completely within the end of tube 46 and the longitudinal edges 42 abut against the inner wall 48 of tube 46 and extend parallel with the main axis of tube 46. The abutting longitudinal edges 42 in combination with the straight, stiff outer sides 14 of central panel 10 reinforce the end of tube 46 when end cap 40 is inserted therein. The tubular section 52 thus provides support to the fragile tube ends which, in the case of wrapping paper, are usually made of thin cardboard. The tubular section 52 of end cap 40 sits within the tube end at a depth which is determined by the length of the free sides **24*a* and 24*b* of intermediate panels 18. Preferably, the length of each confronting free side 24*a* and 24*b* for the adjacent intermediate panels 18 is the same so that the central panel 10 rests essentially perpendicular to the main axis of tube 46 when the end cap 40 is inserted into the end of tube 46. Additionally, the free sides 24*a* and 24 should be straight so as to confront each other along the entire length of each longitudinal edge 42. In this way, the straight outer sides 14 of the central panel 10 cooperate with the contact edges 42 of tubular section 52 to reinforce the ends of tube 46 when the end cap 40 is inserted therein. Furthermore, when sides 24*a* and 24*b* confront along their entire length the longitudinal edges 42 of tubular section 52 are structurally more sound so as to provide greater support to the ends of the tube 46. Finally, as stated hereinabove, the friction between the inner wall 48 of tube 46 and the abutting longitudinal edges 42 of end cap 40 secures end cap 40 firmly within tube 46** without the necessity of separate fastening means.

Figure 4:
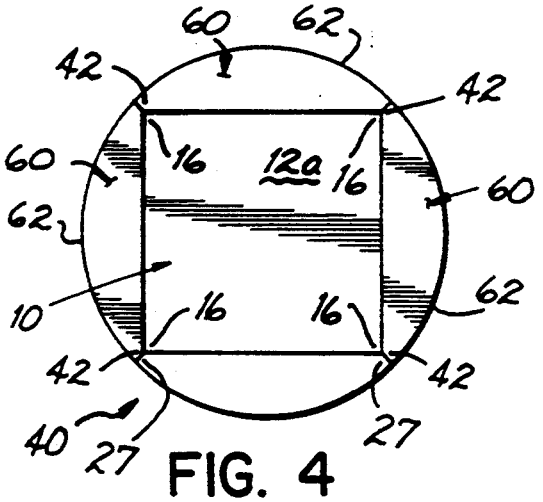
FIG. 4 is a top plan view of the erected end cap of the present invention.

Referring now to FIG. 4, when intermediate panels 18 are folded, as disclosed above, to form tubular section 52, the outer panels 26 are folded radially outward from central panel 10 to collectively form the annular edge-protecting lip 60 of the present invention. Outer panels 26 are folded to lie substantially parallel to central panel 10, and substantially perpendicular to intermediate panels 18. The outer panels 26 extend radially outward from the center of the end cap 40 to overlie the end of the tube 46 and to confine and protect the edges of the sheet material (not shown) rolled on the tube 46. Preferably, the outer side 30 of each outer panel 26 extends beyond the outer edge of the sheet material rolled onto tube 46 so as to completely protect the delicate edges of the roll. In a preferred embodiment of the present invention, the outer sides 30 of the outer panels 26 are arcuate in shape as shown in FIG. 1 so that when the outer panels 26 are folded substantially perpendicular to the intermediate panels 18 to form annular lip 60, the lip 60 will be generally circular in shape to conform to the round ends of the tube 46 and the roll of sheet material. When the confronting free sides **24*a* and 24*b* of the adjacent intermediate panels 18 meet to form the tubular section 52 of the end cap 40, a gap in the annular lip 60 will exist at each corner of the central panel 10 if the outer panels 26 extend directly radially outward in a straight line from the intermediate panels 18. Therefore, in a preferred embodiment of the present invention, each outer panel has an opposing pair of marginal section 27 which meet when adjacent outer panels 26 are folded radially outward to form the peripheral protective ring 60. Thus, when opposing marginal sections 17 of adjacent outer panels 26 meet, a continuous annular generally circular lip 60 is formed around the end cap 40 as shown in FIG. 4 to completely contain and protect the delicate edges of the tube of sheet material when the end cap 40 is inserted into the end of the tube 46. In this way, the entire periphery of the delicate exposed edges of a roll of sheet material, such as a roll of wrapping paper, is protected by annular lip 60** against bumps and drops which may damage the ends of the tube and the material edges of the paper rolled thereon.

Figure 5:
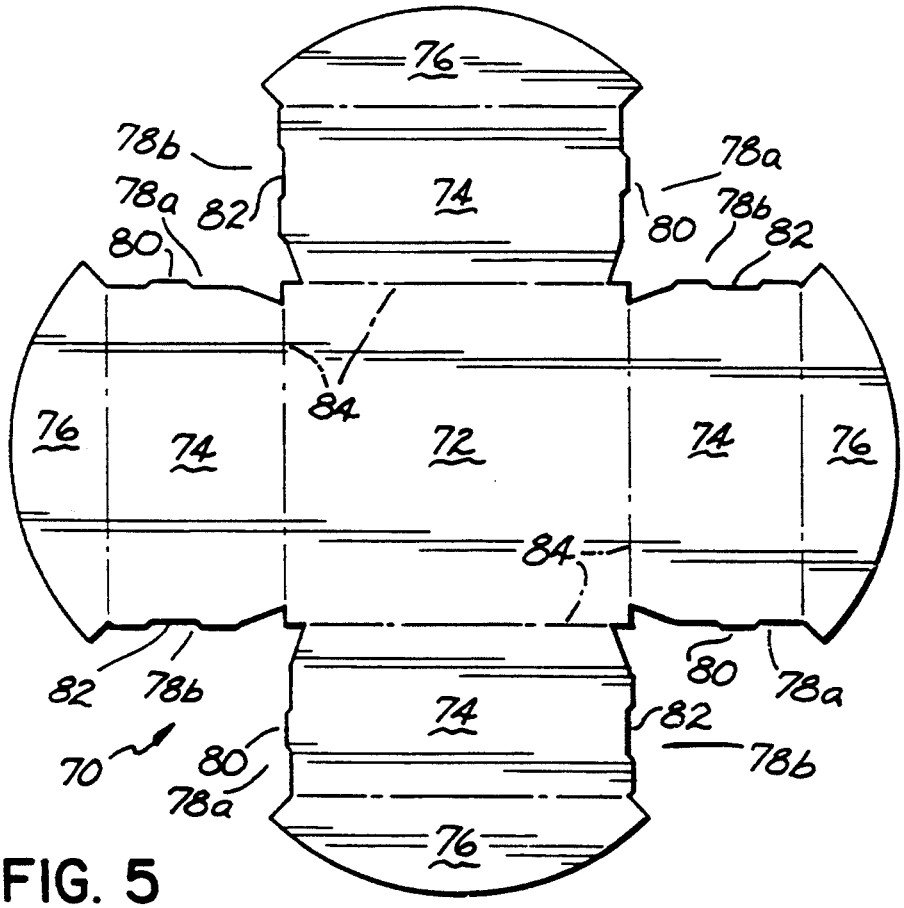
FIG. 5 is a top plan view of the die cut paper blank which is to be folded to form an alternative embodiment of the end cap of the present invention.
Figure 6:
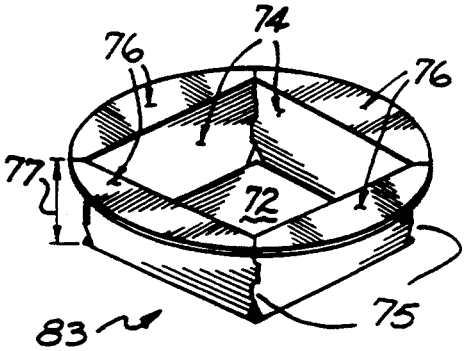
FIG. 6 is a perspective view of an alternative embodiment of the erected end cap of the present invention.

In an alternative embodiment of the present invention, shown in FIGS. 5 and 6, a die-cut paper blank 70 has a central panel 72, intermediate panels 74 and outer panels 76 and is similar in shape and operation to blank 5 which is used to form the end cap 40 disclosed hereinabove. However, as shown in FIG. 5, the confronting free sides **78*a* and 78*b* of the intermediate panels 74 which meet to form the tubular section 77 of this embodiment of the present invention have opposing cooperating tabs 80 and notches 82 which interlock to hold the longitudinal edges 42 of the erected end cap 83 together when the intermediate panels 74 are folded at the sides of the central panel 84 to create the three dimensional end cap 83 as shown in FIG. 6. When the end cap 83 is formed by folding the intermediate panels 74 substantially perpendicular to the central panel 72, the individual intermediate panels 74 will have a tendency to bend inward towards the center of the central panel. Consequently, when pressure is applied to the end of the tube, such as when the tube is dropped or otherwise bumped at its ends, individual intermediate panels may fold inward eliminating one or more of the longitudinal edges 75 and jeopardizing the integrity of the tubular section 77 of the end cap 83. To prevent this, the tabs 80 and notches 82 on the free sides 78*a* and 78*b*** of the intermediate panels 74 interact to maintain the tubular Section 77 and the longitudinal edges 75 so that the end cap 83 provides support to the end of the tube and remains firmly seated therein. Similar to the end cap 40 discussed above, the outer panels 86 of end cap 83 fold substantially perpendicular to the intermediate panels 74 and parallel to and radially outward from the central panel 72 to overlay and protect the edges of the sheet material rolled onto the end of the tube.

As stated earlier, although the preferred embodiment shows a square-shaped central panel and four longitudinal edges, the central panel can be virtually any polygon shape with straight sides and corners. Regardless of the polygonal shape of the central panel, folding the intermediate panels towards one face surface of the central panel forms a tubular section and a plurality of longitudinal edges which hold the end cap in the end of the tube while simultaneously reinforcing the end of the tube.

Similarly, the outer panels may have various shapes and still function to collectively form a peripheral lip surface around the end cap to protect the delicate edges of the sheet material rolled onto the tube.

In the above disclosure of the general principles of the present invention and preceding detailed description of a preferred embodiment, those skilled in the art will readily comprehend the various modifications to which the present invention is susceptible. Therefore, I desire to be limited only by the scope of the following claims and equivalents thereof.

We claim:

1. An end cap for insertion into the end of a tube of rolled sheet material to protect and contain the edges of the sheet material comprising:

a central panel having a plurality of substantially straight outer sides;

a plurality of intermediate panels, each having an inner side hingedly attached to an outer side of the central panel and each intermediate panel folded along its inner side to extend substantially perpendicular to the central panel, the intermediate panels each having an outer side substantially parallel to the inner side thereof and having opposing free sides, the intermediate panels collectively forming a tubular section with the free sides of adjacent intermediate panels confronting each other to define longitudinal edges of the tubular section;

a plurality of outer panels each having an inner side and a free outer side, each outer panel hingedly attached along its inner side to an outer side of an intermediate panel, and being folded outwardly along its inner side such that the entire outer panel extends substantially perpendicular to its associated intermediate panel and parallel to the central panel in a plane spaced from the central panel;

whereby when the central and folded intermediate panels forming the tubular section are inserted into the end of a tube, the longitudinal edges of the tubular section are coincident with the inner wall of the tube to frictionally secure the end cap therein and reinforce the ends of the tube, and the outwardly folded outer panels are disposed adjacent the tube end to contain and protect the exposed edges of sheet material rolled on the tube.

2. The end cap of claim 1 wherein the central panel is in the shape of a regular polygon.

3. The end cap of claim 1 wherein the outer panels each contain opposing marginal sections, the marginal sections of adjacent outer panels confronting each other such that the outer panels collectively form a continuous annular lip around the periphery of the end cap to completely contain and protect the exposed edges of the rolled sheet material.

4. The end cap of claim 1 wherein each outer panel has an arcuate outer side so that the outer panels collectively form a generally circular annular lip around the periphery of the end cap.

5. The end cap of claim 4 wherein the generally circular annular lip has a greater outer diameter than the outer diameter of a tube of rolled sheet material so that the lip completely contains and protects the exposed edges of the rolled sheet material.

6. The end cap of claim 1 wherein the opposing free sides of the intermediate panels are of equal length so that the central panel lies substantially perpendicular to the main axis of the tube when the tubular section of the end cap is inserted in the end of the tube.

7. The end cap of claim 1 wherein the confronting free sides of adjacent intermediate panels have at least one of a tab and a notch, and wherein at least one tab of an intermediate panel interacts with at least one notch of an adjacent intermediate panel to hold the free sides of the intermediate panels in a longitudinal edge when the intermediate panels are folded perpendicular to the central panel to form the tubular section of the end cap.

8. The end cap of claim 1 wherein the end cap is die cut rigid paper stock.

9. An end cap for insertion into the end of a tube of rolled sheet material to protect and contain the edges of the sheet material comprising:

a square-shaped central panel having four substantially straight outer sides and four corners;

a plurality of rectangular intermediate panels each having an inner side hingedly attached to an outer side of the central panel and foldable to extend substantially perpendicular to the central panel, the intermediate panels each having an outer side substantially parallel to the inner side thereof, and having opposing free sides so that when the intermediate panels are folded along their inner sides substantially perpendicular to the central panel, they collectively form a tubular section and the free sides of adjacent intermediate panels confront each other to define longitudinal edges of the tubular section;

a plurality of outer panels each having an inner side and an arcuate outer side, each outer panel hingedly attached along its inner side to an outer side of an intermediate panel and foldable outwardly therealong to extend substantially perpendicular to its associated intermediate panel and substantially parallel to the central panel so that, the outer panels collectively form an annular lip around the periphery of the end cap;

whereby when the central and folded intermediate panels are inserted into the end of a tube, the longitudinal edges of the tubular section formed thereby are coincident with the inner wall of the tube to frictionally secure the end cap therein and reinforce the ends of the tube, and the lip is disposed adjacent the tube end to contain and protect the exposed edges of sheet material rolled on the tube.

10. The end cap of claim 9 wherein the outer panels each contain opposing marginal sections, the marginal sections of adjacent outer panels confronting each other when the outer panels are folded substantially parallel to the central panel so that the outer panels collectively form a continuous annular lip around the periphery of the end cap to completely contain and protect the exposed edges of the rolled sheet material.

11. The end cap of claim 9, the annular lip being substantially circular and having a greater outer diameter than the outer diameter of a tube of rolled sheet material so that the lip completely contains and protects the exposed edges of the rolled sheet material.

12. The end cap of claim 9 wherein the opposing free sides of the intermediate panels are of equal length so that the central panel lies substantially perpendicular to the main axis of the tube when the tubular section of the end cap is inserted in the end of the tube.

13. The end cap of claim 9 the confronting free sides of adjacent intermediate panels have at least one of a tab and a notch, and wherein at least one tab of an intermediate panel interacts with at least one notch of an adjacent intermediate panel to hold the free sides of the intermediate panels in a longitudinal edge when the intermediate panels are folded perpendicular to the central panel to form the tubular section of the end cap.

14. The end cap of claim 9 wherein the end cap is die cut rigid paper stock.

15. A tube assembly for protecting and containing rolled sheet material comprising:

a hollow tube;

sheet material rolled onto the tube so that the edges of the sheet material are flush with the ends of the tube;

an end cap for insertion into the end of the tube to reinforce the tube end and contain and protect the exposed edges of the sheet material, the end cap comprising:

a central panel having a plurality of substantially straight outer sides;

a plurality of intermediate panels, each having an inner side hingedly attached to an outer side of the central panel and foldable to extend substantially perpendicular to the central panel, the intermediate panels each having an outer side substantially parallel to the inner side thereof and having opposing free sides so that when the intermediate panels are folded along their inner side substantially perpendicular to the central panel, they collectively form a tubular section and the free sides of adjacent intermediate panels confront each other to define longitudinal edges of the tubular section;

a plurality of outer panels each having an inner side and an outer side, each outer panel hingedly attached along its inner side to an outer side of an intermediate panel and foldable outwardly therealong to extend substantially perpendicular to its associated intermediate panel and parallel to the central panel;

whereby when the central and folded intermediate panels are inserted into the end of a tube, the longitudinal edges of the tubular section formed thereby are coincident with the inner wall of the tube to frictionally secure the end cap therein and reinforce the ends of the tube and the outwardly folded outer panels are disposed adjacent the tube end to contain and protect the exposed edges of sheet material rolled on the tube.

16. The tube assembly of claim 15 wherein the central panel is in the shape of a square.

17. The tube assembly of claim 15 wherein the outer panels each contain opposing marginal sections, the marginal sections of adjacent outer panels confronting each other when the outer panels are folded substantially parallel to the central panel so that the other panels collectively form a continuous annular lip around the periphery of the end cap to completely contain and protect the exposed edges of the rolled sheet material.

18. The tube assembly of claim 15 wherein each outer panel has an arcuate outer side so that the outer panels collectively form a substantially circular annular lip around the periphery of the end cap when the outer panels are folded substantially parallel to the central panel.

19. The tube assembly of claim 18 wherein the substantially circular annular lip has a greater outer diameter than the outer diameter of a tube of rolled sheet material so that the lip completely contains and protects the exposed edges of the rolled sheet material.

20. The tube assembly of claim 15 wherein the opposing free sides of the intermediate panels are of equal length so that the central panel lies substantially perpendicular to the main axis of the tube when the tubular section of the end cap is inserted in the end of the tube.

21. The tube assembly of claim 15 wherein the confronting free sides of adjacent intermediate panels have at least one of a tab and a notch, and wherein at least one tab of an intermediate panel interacts with at least one notch of an adjacent intermediate panel to hold the free sides of the intermediate panels in a longitudinal edge when the intermediate panels are folded perpendicular to the central panel to form the tubular section of the end cap.

22. The tube assembly of claim 15 wherein the end cap is die cut rigid paper stock.

23. A flat blank to be folded into an end cap for insertion into the end of a tube of rolled sheet material to protect and confine the edges of the sheet material comprising:

a central panel with a plurality of substantially straight outer sides;

a plurality of intermediate panels having opposing free sides, each intermediate panel having an outer side and an inner side substantially parallel the outer side, wherein the inner side is hingedly attached to an outer side of the central panel so as to be folded therealong essentially perpendicular to the central panel to collectively form a tubular section with longitudinal edges formed by confronting free sides of adjacent intermediate panels; and a plurality of outer panels each having an inner side and an outer side, each outer panel hingedly attached along its inner side to an outer side of an intermediate panel, so as to be folded substantially perpendicular to the intermediate panel and substantially parallel to the central panel;

the outer panels each contain opposing marginal sections, the marginal sections of adjacent outer panels confronting each other when the outer panels are folded substantially parallel to the central panel so that the outer panels collectively form a continuous annular lip around the periphery of the end cap to completely contain and protect the exposed edges of the rolled sheet material.

24. The blank of claim 23 wherein the central panel is in the shape of a regular polygon.

25. The blank of claim 23 wherein each outer panel has an arcuate outer side so that the outer panels collectively form a generally circular annular lip around the periphery of the end cap when the outer panels are folded substantially parallel to the central panel.

26. The blank of claim 23 wherein the opposing free sides of the intermediate panels are of equal length so that when the blank is folded to form an end cap the central panel lies substantially perpendicular to the main axis of the tube when the tubular section of the end cap is inserted in the end of the tube.

27. The blank of claim 23, wherein the blank is die cut rigid paper stock.

28. A flat blank to be folded into an end cap for insertion into the end of a tube of rolled sheet material to protect and confine the edges of the sheet material comprising:

a central panel with a plurality of substantially straight outer sides;

a plurality of intermediate panels having opposing free sides, each intermediate panel having an outer side and an inner side substantially parallel the outer side, wherein the inner side is hingedly attached to an outer side of the central panel so as to be folded therealong essentially perpendicular to the central panel to collectively form a tubular section with longitudinal edges formed by confronting free sides of adjacent intermediate panels the confronting free sides of adjacent intermediate panels having at least one of a tab and a notch, and wherein at least one tab of an intermediate panel interacts with at least one notch of an adjacent intermediate panel to hold the free sides of the intermediate panels in a longitudinal edge when the intermediate panels are folded perpendicular to the central panel to form the tubular section of the end cap; and a plurality of outer panels each having an inner side and an outer side, each outer panel hingedly attached along its inner side to an outer side of an intermediate panel, so as to be folded substantially perpendicular to the intermediate panel and substantially parallel to the central panel.

29. A method of protecting and containing the edges of a roll of sheet material rolled onto a tube with opposing ends and an inner wall comprising the steps of:

a) providing a blank comprising a central panel with two face surfaces and a plurality of substantially straight outer sides, a plurality of intermediate panels each with opposing free sides, an inner side and an outer side, each intermediate panel having an inner side hingedly attached to an outer side of the central panel, and a plurality of outer panels each having an inner side and an outer side, each outer panel hingedly attached along its inner side to an outer side of an intermediate panel;

b) folding each intermediate panel at its inner side towards one face surface of the central panel so that the intermediate panels extend substantially perpendicular to the central panel;

c) aligning adjacent intermediate panels with each other so that the free sides of adjacent intermediate panels confront each other to collectively form a tubular section having longitudinal edges at the corners of the central panel;

d) inserting the tubular section into an end of the tube so that the longitudinal edges frictionally engage the inner wall of the tube to protect the edges of the roll of sheet material and to reinforce the end of the tube;

e) folding each outer panel at its inner side in a direction outwardly from the central panel so that each outer panel extends substantially perpendicular to its associated intermediate panel and parallel to the central panel; and f) positioning the outer panels to collectively form an annular lip around the tube end to contain and further protect the exposed edges of sheet material rolled on the tube.

30. The method of claim 29 wherein the confronting free sides of the intermediate panels include at least one of a tab and a notch, the method further comprising the step of:

a) inserting the free side tab of one intermediate panel into the free side notch of an adjacent intermediate panel when the intermediate panels are folded to rest substantially perpendicular to the central panel and aligned to form a tubular section so as to hold adjacent intermediate panels together in a longitudinal edge and hold the tubular section together.

31. The method of claim 29 wherein each outer panel has an arcuate outer side so that the outer panels collectively form a substantially circular annular lip around the tube end when the outer panels are folded.

32. The method of claim 32 wherein the formed annular lip has a greater outer diameter than the outer diameter of a tube of rolled sheet material so that the lip completely contains and protects the exposed edges of the rolled sheet material on the tube.

33. An end cap of insertion into the end of a tube of rolled sheet material to protect and contain the edges of the sheet material comprising:

a central panel having a plurality of substantially straight outer sides;

a plurality of intermediate panels, each having an inner side hingedly attached to an outer side of the central panel and each intermediate panel folded along its inner side to extend substantially perpendicular to the central panel, the intermediate panels each having an outer side substantially parallel to the inner side thereof and having opposing free sides, the intermediate panels collectively forming a tubular section with the free sides of adjacent intermediate panels confronting each other to define longitudinal edges of the tubular section;

a plurality of outer panels each having an inner side and an outer side, each outer panel hingedly attached along its inner side to an outer side of an intermediate panel and being folded outwardly along its inner side to extend substantially perpendicular to its associated intermediate panel and parallel to the central panel in a plane spaced from the central panel, the outer panels each containing opposing marginal sections which confront each other such that the outer panels collectively form a continuous annular lip around the periphery of the end cap, whereby when the central and folded intermediate panels forming the tubular section are inserted into the end of a tube, the longitudinal edges of the tubular section are coincident with the inner wall of the tube to frictionally secure the end cap therein and reinforce the ends of the tube, and the continuous annular lip is disposed adjacent the tube end to contain and protect the exposed edges of sheet material rolled on the tube.

34. The end cap of claim 33 wherein each outer panel has an arcuate outer side so that the outer panels collectively form a generally circular annular lip around the periphery of the end cap.

35. The end cap of claim 34 wherein the generally circular annular lip has a greater outer diameter than the outer diameter of a tube of rolled sheet material so that the lip completely contains and protects the exposed edges of the rolled sheet material.

36. The end cap of claim 33 wherein the confronting free sides of the intermediate panels have at least one of a tab and a notch, at least one tab of an intermediate panel interacting with at least one notch of an adjacent intermediate panel to hold the free sides of the intermediate panels in a longitudinal edge and hold the tubular section together.

* * * * *